US009787012B2

(12) United States Patent
Kawaguchi et al.

(10) Patent No.: US 9,787,012 B2
(45) Date of Patent: Oct. 10, 2017

(54) TERMINAL FITTING WITH RESILIENT PIECES HAVING THIN PLATING REGION AND THICK PLATING REGION

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Daichi Kawaguchi, Mie (JP); Shiro Nishida, Mie (JP); Nobuyuki Akiba, Mie (JP); Takuya Utsunomiya, Mie (JP); Fumitaka Maekawa, Mie (JP)

(73) Assignees: AUTONETWORKS TECHNOLOGIES, LTD., Yokkaichi, Mie (JP); SUMITOMO WIRING SYSTEMS, LTD., Yokkaichi, Mie (JP); SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 0 days.

(21) Appl. No.: 14/910,726

(22) PCT Filed: Sep. 8, 2014

(86) PCT No.: PCT/JP2014/073625
§ 371 (c)(1),
(2) Date: Feb. 8, 2016

(87) PCT Pub. No.: WO2015/045826
PCT Pub. Date: Apr. 2, 2015

(65) Prior Publication Data

US 2016/0197426 A1 Jul. 7, 2016

(30) Foreign Application Priority Data

Sep. 27, 2013 (JP) ..... 2013-202381

(51) Int. Cl.
*H01R 11/22* (2006.01)
*H01R 13/11* (2006.01)
(Continued)

(52) U.S. Cl.
CPC ..... *H01R 13/111* (2013.01); *H01R 4/18* (2013.01); *H01R 13/03* (2013.01); *H01R 4/183* (2013.01)

(58) Field of Classification Search
CPC ..... H01R 13/111; H01R 13/113; H01R 9/091; H01R 13/11; H01R 13/112; H01R 13/2442; H01R 13/03
(Continued)

(56) References Cited

U.S. PATENT DOCUMENTS 3,437,977 A * 4/1969 Strobel ..... H05K 3/244 174/257
3,675,320 A * 7/1972 Watanabe ..... H01R 13/112 29/874
(Continued)

FOREIGN PATENT DOCUMENTS

JP 55-164775 5/1954
JP 63-121693 5/1988
(Continued)

OTHER PUBLICATIONS

International Search Report.

*Primary Examiner* — Thanh Tam Le
(74) *Attorney, Agent, or Firm* — Gerald E. Hespos; Michael J. Porco; Matthew T. Hespos

(57) ABSTRACT

It is aimed to provide a terminal fitting (1) in which thick plating films can be formed on necessary parts without requiring particularly complicated plating. The terminal fitting (10) includes a tubular connecting portion (11) into which a mating male terminal (60) is insertable. The con-
(Continued)

necting portion (11) includes a plurality of resilient pieces (14) circumferentially divided via expanding slots (13) extending from a tip. Thick film portions (22) with a thicker plating film than in other parts are provided on inner surfaces of the plurality of resilient pieces (14) and contact areas (17) capable of contacting the male terminal (60) are provided on these thick film portions (22). The thick film portions (22) and the contact areas (17) are arranged continuously in a circumferential direction except at the positions of the expanding slots (13) on an inner surface of the connecting portion (11) near a tip.

9 Claims, 8 Drawing Sheets

(51) Int. Cl.
*H01R 13/03* (2006.01)
*H01R 4/18* (2006.01)

(58) Field of Classification Search
USPC ..... 439/851–857, 862, 886
See application file for complete search history.

(56) References Cited

U.S. PATENT DOCUMENTS 3,797,108 A * 3/1974 Healy ..... B21D 28/06 29/847
4,026,627 A * 5/1977 Benasutti ..... H01R 12/721 439/377
4,546,542 A * 10/1985 Proud ..... H01R 43/16 29/564.6
4,588,240 A * 5/1986 Ruehl ..... H01R 31/08 439/513
4,650,723 A * 3/1987 Furuya ..... B32B 15/08 428/457
4,723,923 A 2/1988 Senor et al.
4,825,541 A * 5/1989 Czeschka ..... H01R 43/16 29/874
5,263,883 A * 11/1993 Kirayoglu ..... H01R 43/16 439/856
5,316,507 A * 5/1994 Capp ..... C10M 103/04 439/886
5,919,066 A * 7/1999 Harting ..... H01R 13/052 439/825
6,168,841 B1 * 1/2001 Chen ..... G09F 3/10 283/81
6,186,841 B1 * 2/2001 Jacobsson ..... H01R 13/111 439/851
6,488,550 B1 * 12/2002 Kikuchi ..... H01R 13/112 439/857
6,613,451 B1 * 9/2003 Asahara ..... C23C 2/02 205/226
6,827,608 B2 * 12/2004 Hall ..... H01R 13/6315 439/578
6,899,572 B1 * 5/2005 Baker ..... H01R 13/111 439/181
6,979,235 B2 * 12/2005 Lappohn ..... H01R 13/111 439/733.1
8,840,436 B2 * 9/2014 Mott ..... H01R 13/111 439/843

FOREIGN PATENT DOCUMENTS

JP 2-38675 8/1990
JP 4-52381 5/1992
JP 2012-124112 6/2012

* cited by examiner

TERMINAL FITTING WITH RESILIENT PIECES HAVING THIN PLATING REGION AND THICK PLATING REGION

BACKGROUND

1. Field of the Invention

The present invention relates to a terminal fitting.

2. Description of the Related Art

A terminal fitting disclosed in Japanese Examined Patent Publication No. H02-38675 includes a connecting portion (electrical contact portion) in the form of a rectangular tube into which a mating male terminal is insertable. This connecting portion is immersed in a plating solution in a plating bath and the plating solution is injected from an injection nozzle to flow through the connecting portion with a tip opening of the connecting portion faced toward the injection nozzle in the plating bath, whereby a plating film is formed on the inner surface of the connecting portion. In this case, the connecting portion includes contact portions to be connected electrically to the male terminal on a pair of wall sides facing each other. According to the above configuration, it is possible to form thicker plating films on necessary parts including the contact portions than on other parts.

The contact portions of the above-described conventional terminal fitting are provided only on parts of the inner surface of the connecting portion in a circumferential direction (pair of wall sides facing each other). On the other hand, according to the above configuration, the plating film is formed on the inner surface of the connecting portion over the entire circumference and the thick plating layer formed on parts other than the necessary parts such as the contact portions is useless. Contrary to this, thick plating films can be formed only on the necessary parts by masking parts the inner surface of the connecting portion in the circumferential direction. However, since the parts of the inner surface of the connecting portion in the circumferential direction are masked, there have been problems of difficult plating and lacking reality.

The present invention was completed based on the above situation and aims to provide a terminal fitting in which thick plating films can be formed on necessary parts without requiring particularly complicated plating.

SUMMARY

The present invention is directed to a terminal fitting including a tubular connecting portion into which a mating male terminal is insertable. The connecting portion includes a plurality of resilient pieces circumferentially divided via expanding slots extending from a tip. Thick film portions with a thicker plating film than other parts are provided on inner surfaces of the plurality of resilient pieces. Contact areas capable of contacting the male terminal are provided on the thick film portions. The thick film portions and the contact areas are arranged continuously in a circumferential direction except at the positions of the expanding slots on an inner surface of the connecting portion near a tip. Accordingly, the plating films of the thick film portions can be formed easily without masking parts of the inner surface of the connecting portion in the circumferential direction. In addition, the contact areas can be formed on the thick film portions without waste. Thus, according to the present invention, a terminal fitting is provided in which thick plating films can be formed on necessary parts without requiring particularly complicated plating.

The terminal fitting may include a tubular crimping portion open toward a side opposite to a side where the connecting portion is open. A wire is connectable to an inner surface of the crimping portion by crimping. A thin film portion is provided on the inner surface of the crimping portion and has a thinner plating film than the thick film portions. A thick plating film of the crimping portion may cause cracks to be formed on the surface of the plating film of the crimping portion in a crimping process. However, the crimping portion is formed with the thin film portion. Therefore, cracks are unlikely to be formed on the surface of the plating film of the crimping portion. Further, cost is reduced since it is not necessary to form a thick plating film on the crimping portion.

The contact area may include a guiding portion widened toward the tip and capable of guiding the male terminal into the connecting portion. A contact portion may be arranged behind the guiding portion in a guiding direction and may be configured for being connected to the male terminal when the male terminal is inserted properly. The thick film portion may be arranged across the contact portion and the guiding portion. Thus, the thick film portion is provided on both the guiding portion and the contact portion. Therefore, the connecting portion is protected by the thick film portions from an initial stage of guiding the male terminal into the connecting portion.

The resilient piece may include a corner round portion in the form of a curved surface continuous from the inner surface of the resilient piece to a side surface facing the expanding slot. Additionally, the thick film portion may include a surface part in the form of a curved surface extending along the corner round portion. These shapes can prevent the edge-like contact areas from contacting the male terminal at the positions corresponding to the corner round portions of the resilient pieces and ensure the contact reliability of the male terminal with the contact areas.

DETAILED DESCRIPTION

A first embodiment of the present invention is described with reference to FIGS. 1 to 7. A terminal fitting 10 of the first embodiment is formed into a shape long and narrow in a front-back direction as a whole such as by bending an electrically conductive metal plate and, as shown in FIG. 6, includes a tubular connecting portion 11 into which a mating male terminal 60 is insertable from front and a crimping portion 12 arranged behind the connecting portion 11.

Figure 6:
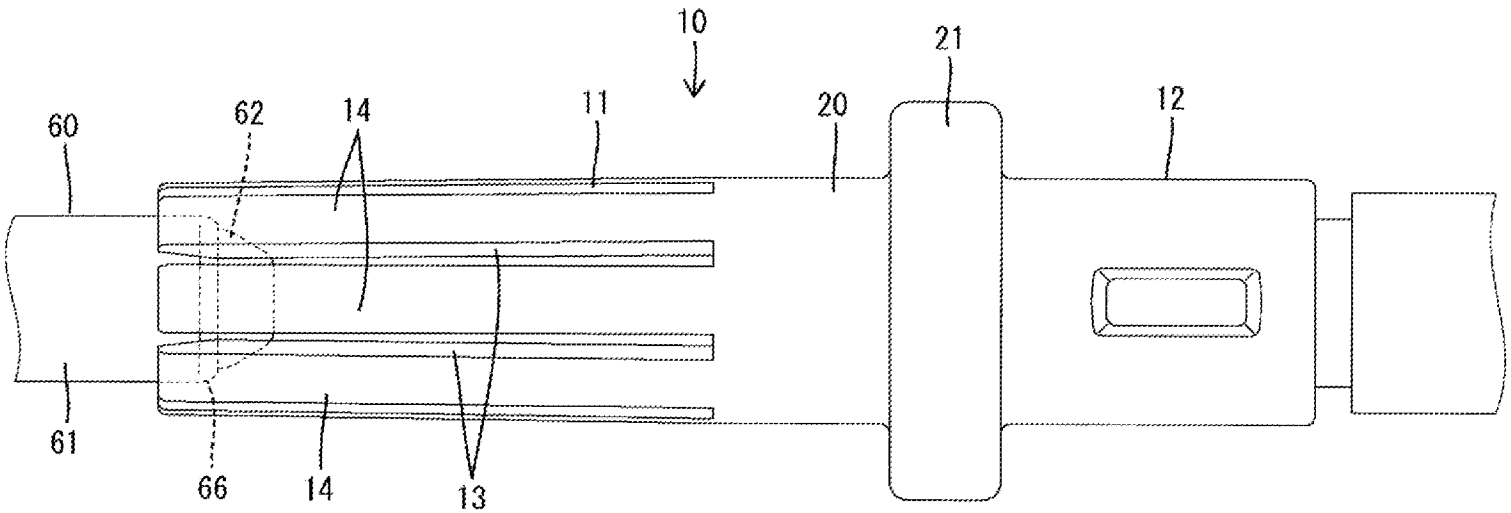
FIG. 6 is a side view showing a state where the terminal fitting connected to the wire is in contact with a male terminal.
Figure 7:
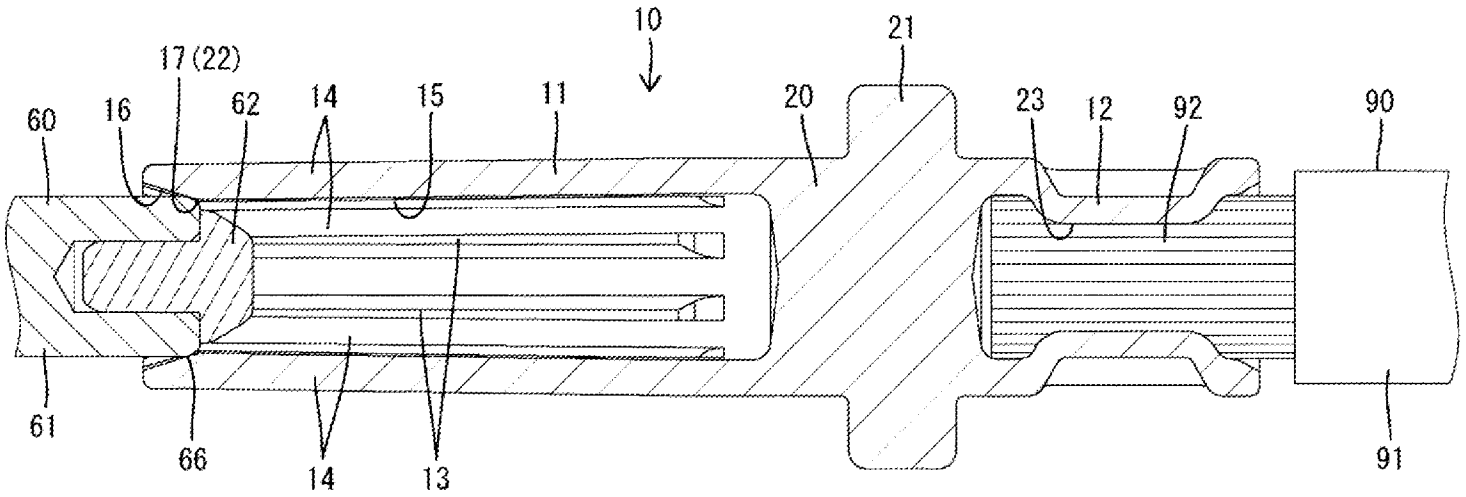
FIG. 7 is a section showing the state where the terminal fitting connected to the wire is in contact with the male terminal.

As shown in FIG. 6, the male terminal 60 includes a connecting pin 61 in the form of a bar long and narrow in the front-back direction, specifically in the form of a cylindrical column. As shown in FIG. 7, a resin member 62 for preventing electrification is incorporated on a tip side of the connecting pin 61. The outer periphery of the resin member 62 is tapered to be narrower toward the tip side.

Figure 4:
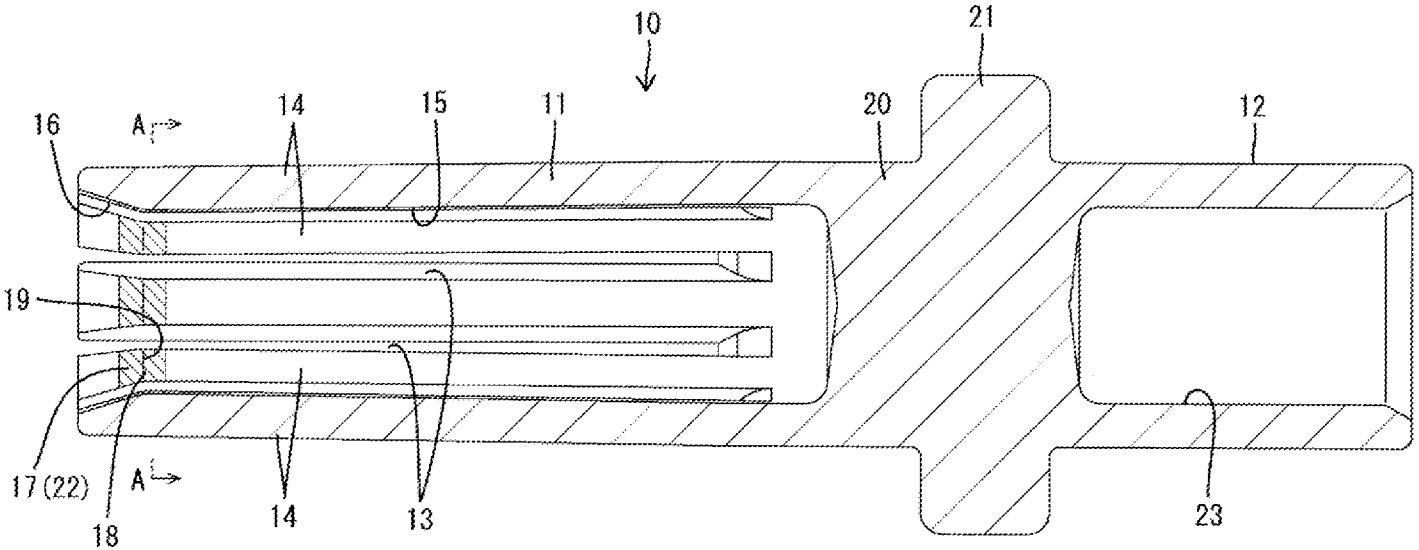
FIG. 4 is a section of the terminal fitting.

As shown in FIG. 4, the crimping portion 12 is in the form of a closed barrel and has a hollow cylindrical shape open backward. As shown in FIG. 7, the crimping portion 12 is crimped and connected to a core portion 92 exposed by removing a coating 91 at a front end part of a wire 90. An intermediate part of the crimping portion 12 in the front-back direction is deformed and narrowed over the entire circumference by being crimped.

Figure 1:
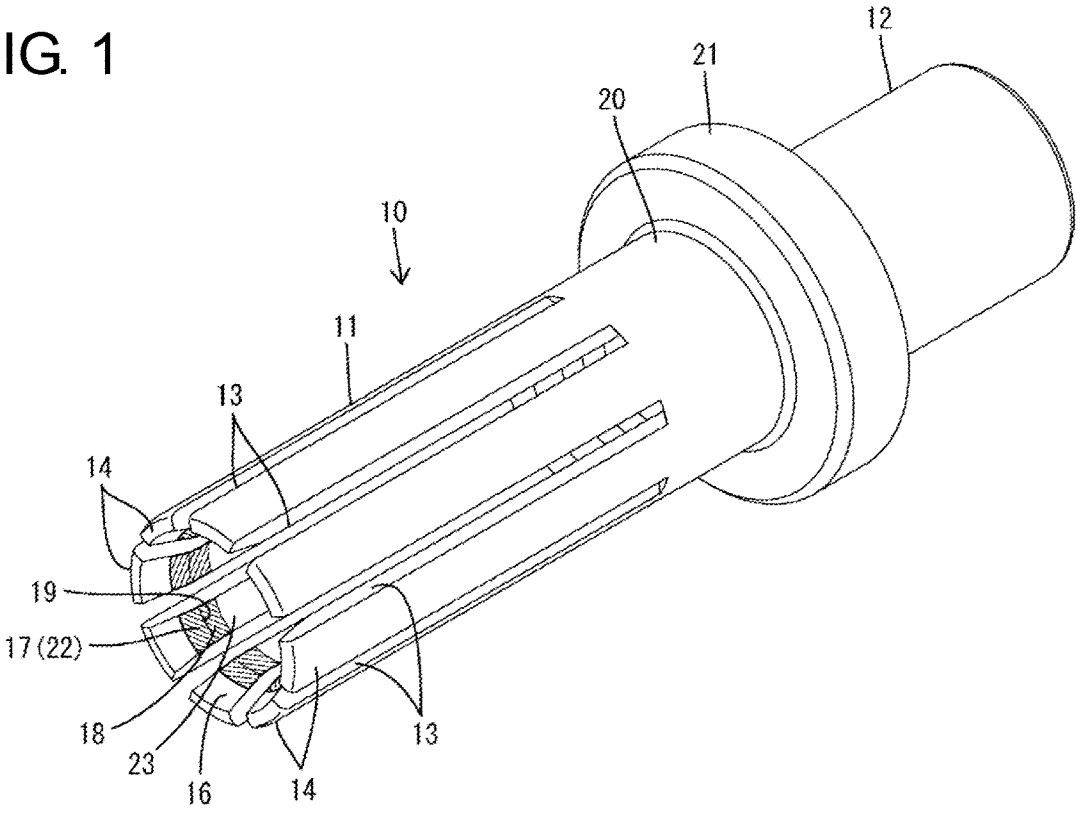
FIG. 1 is a perspective view of a terminal fitting of a first embodiment.
Figure 2:
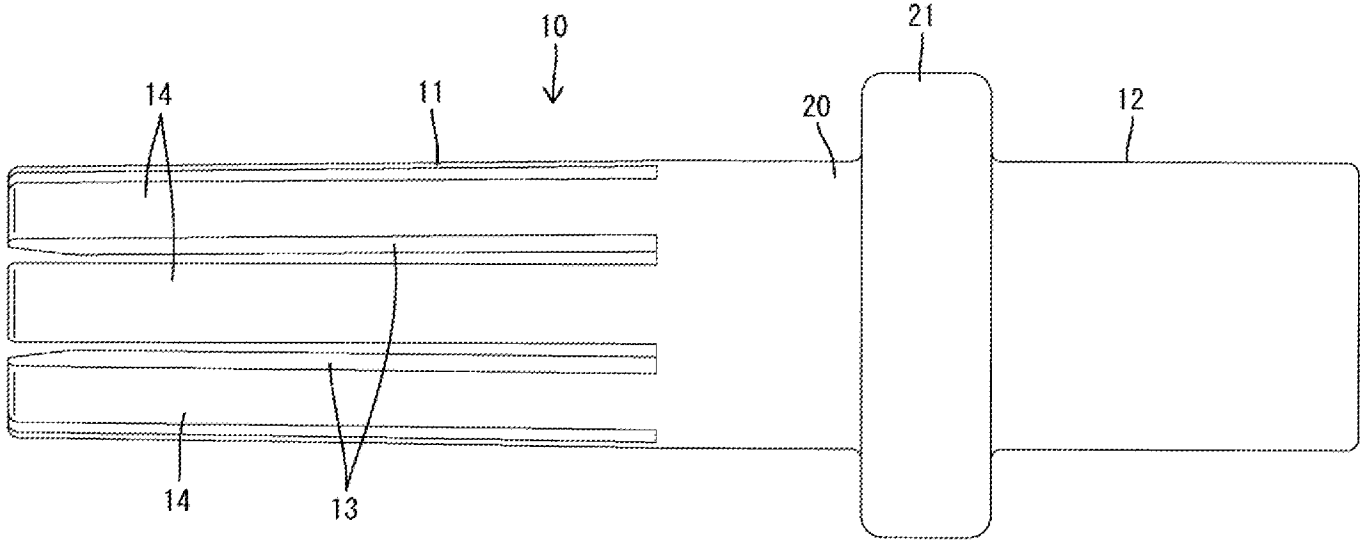
FIG. 2 is a side view of the terminal fitting.
Figure 3:
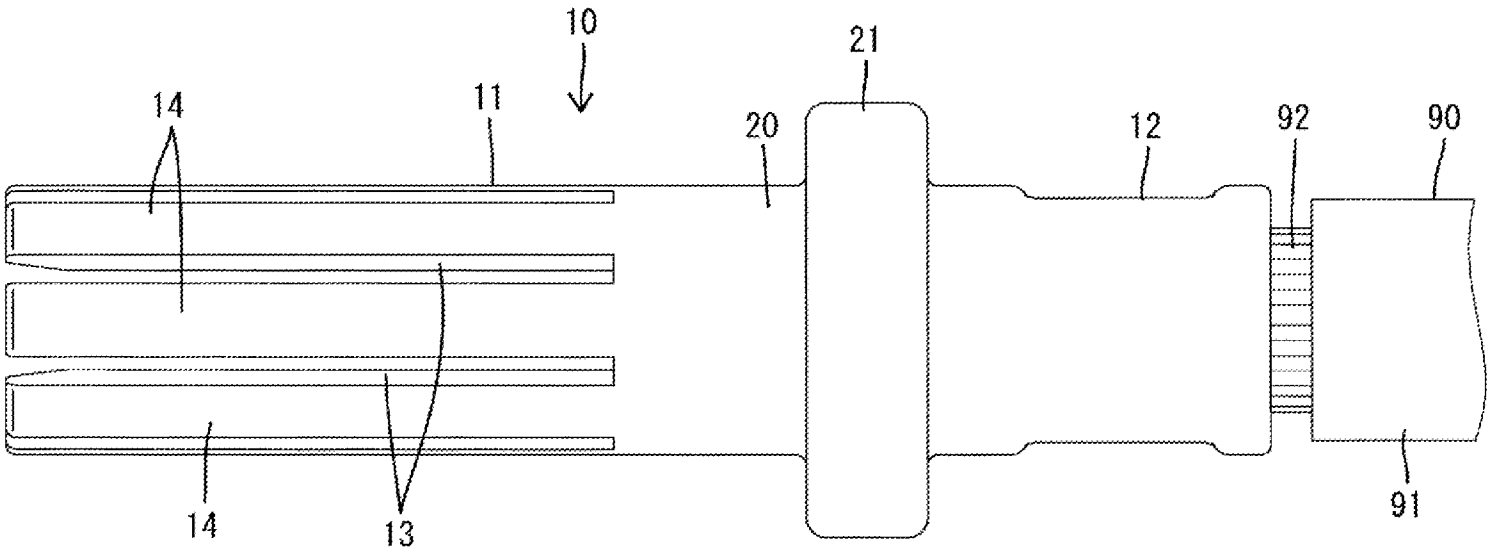
FIG. 3 is a side view of the terminal fitting connected to a wire.

As shown in FIG. 4, the connecting portion 11 is in the form of a cylindrical tube open forward and longer than the crimping portion 12. As shown in FIG. 1, the connecting portion 11 is formed with a plurality of expanding slots 13 at equal intervals in a circumferential direction. Each expanding slot 13 radially penetrates through the connecting portion 11 as shown in FIG. 5 and extends in the front-back direction to be open on the front end of the connecting portion 11 as shown in FIG. 1.

Figure 5:
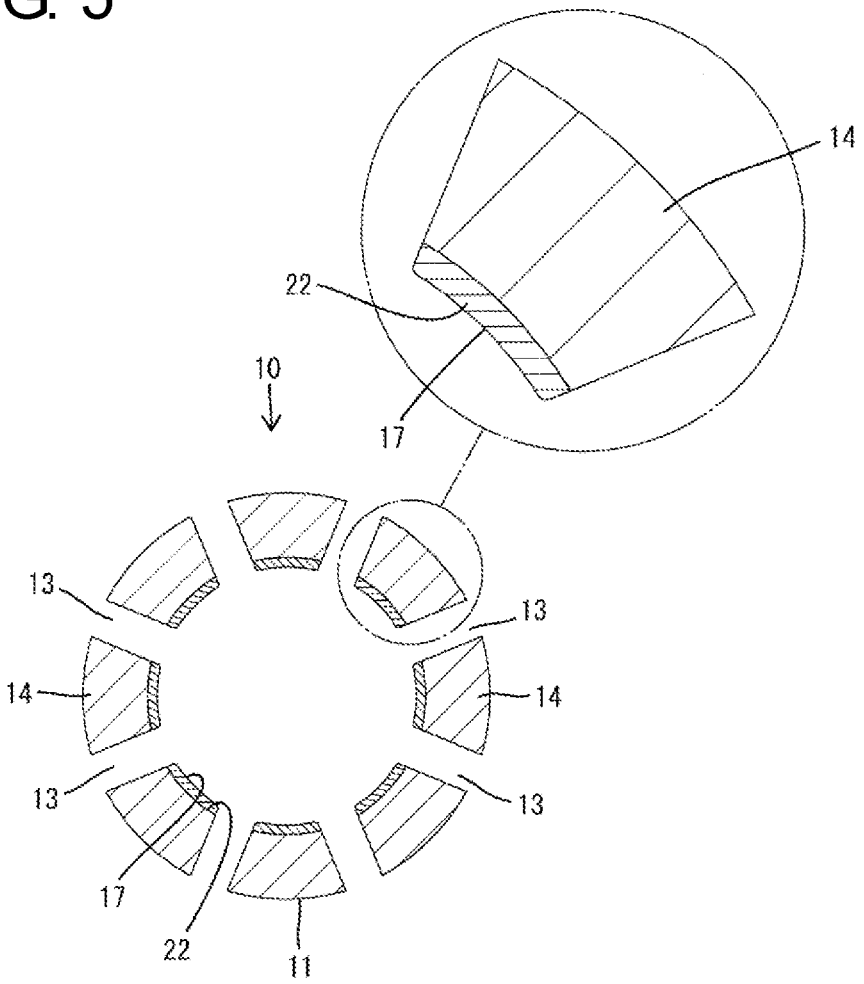
FIG. 5 is a section along A-A of FIG. 4.

As shown in FIGS. 1, 4 and 5, a plurality of resilient pieces 14 are separately provided between the expanding slots 13 on the connecting portion 11. As shown in FIG. 4, the inner surface of the resilient piece 14 in a natural state has a narrow portion 15 slightly radially narrowed and extending forward from the rear end and a guiding portion 16 widened toward the front end from a narrow end 19 of the narrow portion 15 on a front end part.

Further, as shown in FIGS. 1 and 5, a contact area 17 capable of electrically contacting the male terminal 60 is provided on the inner surface of the resilient piece 14. The contact areas 17 are arranged continuously in a strip-like manner substantially over the entire circumference except at the positions of the respective expanding slots 13 on the inner surface of the connecting portion 11 near the front end. Specifically, the contact area 17 is arranged in a predetermined area of the inner surface of the resilient piece 14 in the front-back direction across the narrow end 19. As shown in FIG. 4, the contact area 17 is provided with a contact portion 18, which resiliently contacts the outer peripheral surface of the connecting pin 61 to establish an electrical connection when the connecting pin 61 of the male terminal 60 is inserted to a proper depth into the connecting portion 11, behind the narrow end 19.

Further, as shown in FIGS. 1 and 4, the terminal fitting 10 includes a solid coupling portion 20 having a circular cross-section between the connecting portion 11 and the crimping portion 12. A circular flange portion 21 is provided to protrude in the circumferential direction on the outer peripheral surface of the coupling portion 20.

The entire surface of the terminal fitting 10 is covered with a plating film by applying plating such as silver plating. Specifically, as shown in FIGS. 1 and 4, the plating film is composed of thick film portions 22 having a relatively large thickness and provided on parts of the inner surface of the connecting portion 11 corresponding to the aforementioned contact areas 17 and thin film portions 23 (not specifically shown) having a relatively small thickness and provided on parts excluding the contact areas 17. In other words, surfaces (inner surfaces) of the thick film portions 22 serve as the contact areas 17 as shown in FIG. 5 and, similar to the contact areas 17, the thick film portions 22 are arranged continuously in a strip-like manner substantially over the entire circumference except at the positions of the respective expanding slots 13 on the inner surface of the connecting portion 11 near the front end and in predetermined areas of the inner surfaces of the respective resilient pieces 14 in the front-back direction across the narrow ends 19 as shown in FIGS. 1 and 4. Further, as shown in FIG. 6, the thin film portions 23 are provided on all parts excluding the contact areas 17, including the inner surface of the crimping portion 12 to be crimped to the core portion 92 of the wire 90.

Next, a method for forming the plating film on the terminal fitting 10 of the first embodiment and connection to the mating male terminal 60 are described.

In forming the plating film, predetermined plating is performed such as by immersing the entire terminal fitting 10 into a plating solution in an unillustrated plating bath. In this way, parts corresponding to the thin film portions 23 with a thin plating film are formed on the entire surface of the terminal fitting 10. Subsequently, a tip part of the connecting portion 11 is likewise immersed into a plating solution in a likewise unillustrated plating bath with predetermined areas of the outer and inner surfaces of the connecting portion 11 masked. In this way, the thick film portions 22 with a thick plating film are formed to be laminated on the thin film portions 23 on the inner side of the connecting portion 11.

On the other hand, when the male terminal 60 is inserted into the connecting portion 11 as shown in FIG. 6 for connection to the mating male terminal 60, a tip part of the connecting pin 61 of the male terminal 60 comes into contact with the respective guiding portions 16 of the thick film portions 22 of the connecting portion 11 and the connecting pin 61 is guided into the connecting portion 11 while sliding on the guiding portions 16 to be centered. In the case of the first embodiment, if the male terminal 61 is in a proper insertion posture as shown in FIG. 7, the resin member 62 is inserted into the connecting portion 11 without contacting the respective resilient pieces 14, and a shoulder portion 66 of the tip part of the connecting pin 61 in the form of a curved surface on an outer peripheral side of a seating surface for receiving the resin member 62 first comes into contact with (first touches) the guiding portions 16 of the thick film portions 22.

Further, each resilient piece 14 is resiliently deformed with the rear end thereof as a supporting point as coming into contact with the connecting pin 61, and the narrow portion 15 becomes substantially horizontal in the front-back direction. Thereafter, when the connecting pin 61 is inserted to the proper depth into the connecting portion 11, the connecting pin 61 contacts the contact portion 18 of each thick film portion 22 of the connecting portion 11 with a resilient reaction force of each resilient piece 14 maintained, with the result that the terminal fitting 10 is held in a state conductively connected to the male terminal 60. At this time, the connecting pin 61 is in contact with the contact portions 18 of the contact areas 17 substantially over the entire circumference except at the positions of the respective expanding slots 13. Note that the terminal fitting 10 and the male terminal 60 are respectively mounted in unillustrated connector housings and the aforementioned connecting operation is performed in conjunction with a connecting operation of the respective connector housings.

As described above, since the thick film portions 22 are arranged continuously in the circumferential direction except at the positions of the expanding slots 13 at the position of the connecting portion 11 near the front end according to the first embodiment, it is not necessary to partially mask the inner surface of the connecting portion 11 in the circumferential direction and special plating for masking in the circumferential direction is not necessary. In addition, since the contact areas 17 are provided on the surfaces of the thick film portions 22 over the entire circumference, i.e. since the thick film portions 22 are substantially provided only on necessary parts without being wasted, cost is reduced.

Since the thin film portions 23 can be provided on the parts where the plating film is not particularly necessary by providing the thick film portions 22 only on the substantially necessary parts, cost is more reduced. Particularly, if the plating film of the crimping portion 12 is thick, there is a possibility of causing cracks on the surface of the plating film of the crimping portion 12 in a crimping process. However, since the crimping portion 12 is provided with the thin film portion 23 according to the first embodiment, the formation of cracks on the surface of the plating film of the crimping portion 12 is prevented.

Further, since the thick film portions 22 are provided also on the guiding portions 16 of the contact areas 17, the connecting portion 11 is effectively protected by the thick film portions 22 from an initial stage of guiding the male terminal 60 into the connecting portion 11 and the exposure of a base material can be avoided.

Figure 8:
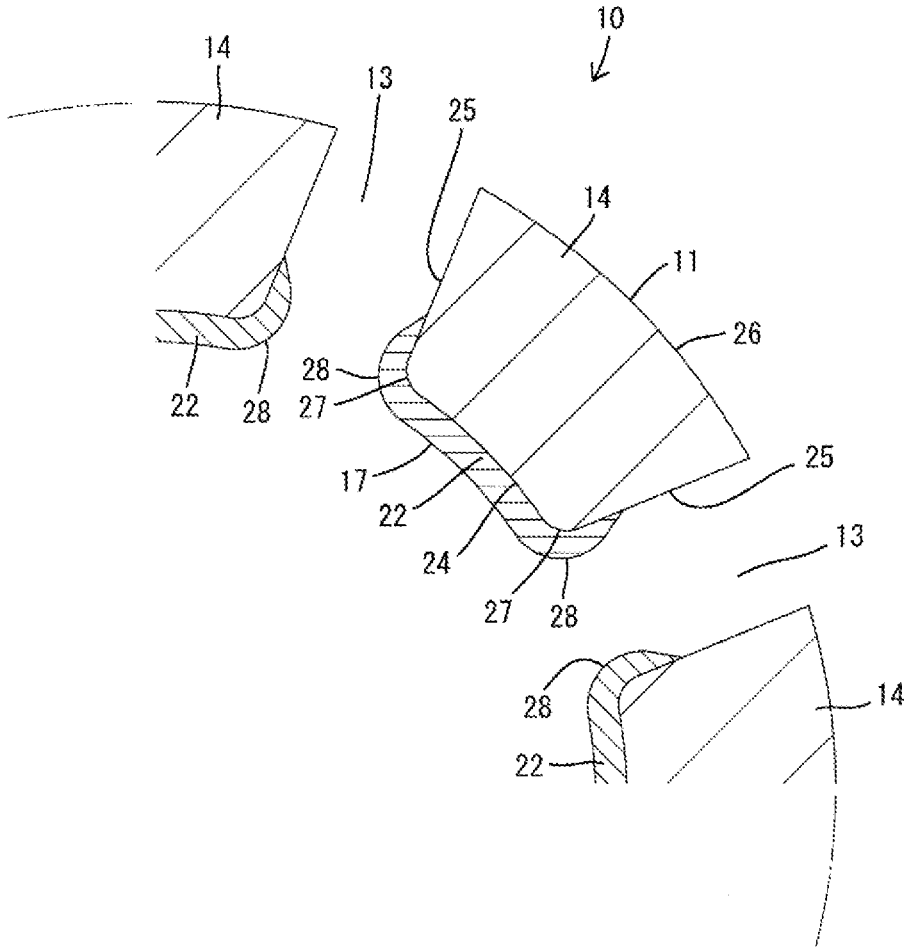
FIG. 8 is an enlarged section of an essential part of a terminal fitting of a second embodiment.

FIG. 8 shows an enlarged section of each resilient piece 14 provided with a thick film portion 22 in a terminal fitting 10 of a second embodiment of the present invention. In the second embodiment, a film formation mode of the thick film portion 22 on each resilient piece 14 is different from the first embodiment and the shape of a part of each resilient piece 14 covered with the thick film portion 22 is different from the first embodiment. Since the other points are the same as in the first embodiment, parts identical or similar to those of the first embodiment are denoted by the same reference signs and repeated description is omitted.

The resilient piece 14 is defined by an inner arcuate surface 24 serving as the inner surface of a connecting portion 11, a pair of side surfaces 25 facing expanding slots 13 and an outer arcuate surface 26 serving as the outer surface of the connecting portion 11. This point is the same as in the first embodiment, but two corner parts extending from the inner arcuate surface 24 to the both side surfaces 25 serve as corner round portions 27 in the form of rounded curved surfaces, which is different from the first embodiment.

Further, the thick film portion 22 includes parts to be laminated on the both corner round portions 27 and parts of the both side surfaces 25 in addition to a part to be laminated on the inner arcuate surface 24 of the resilient piece 14. Particularly, the parts corresponding to the both corner round portions 27 are configured to include surface portions 28 in the form of curved surfaces extending along the corner round portions 27. The surface portions 28 are arranged continuously with a contact area 17 and may be included in the contact area 17.

If the two corner parts extending from the inner arcuate surface 24 to the both side surfaces 25 are formed into angular edges on the resilient piece 14 unlike the above case, parts of the thick film portion 22 corresponding to the both corner parts locally largely protrude. Thus, when the mating male terminal 60 is inserted into the connecting portion 11, the protruding parts of the thick film portion 22 locally come into contact with the male terminal 60 and the terminal fitting 10 may not be stably connected to the male terminal 60.

Contrary to this, since the parts of the inner surface of the thick film portion 22 corresponding to the corner round portions 27 serve as the surface portions 28 in the form of curved surfaces in the configuration of the second embodiment, a situation where the thick film portion 22 comes into line or point contact with the male terminal 60 is avoided. As a result, a state where the terminal fitting 10 is stably connected to the male terminal 60 is ensured.

The present invention is not limited to the above described and illustrated embodiments. For example, the following modes are also included in the technical scope of the present invention.

The thick film portions have only to be provided on necessary parts of the terminal fitting and may be provided on necessary parts other than the contact areas. For example, the thick film portions may be provided up to the tip of the inner surface of the connecting portion by performing second plating without masking the tip side of the inner surface of the connecting portion 11.

Formation areas of the contact areas and those of the thick film portions need not necessarily coincide. For example, areas of the thick film portions in the front-back direction may be larger than those of the contact areas in the front-back direction.

The plating film may be formed by other plating such as gold plating without being limited to silver plating.

A plating method is not limited to the aforementioned so-called dipping method and any plating method capable of dispensing with the masking on the outer peripheral side of the connecting portion can be adopted.

The resin member of the male terminal may first come into contact with (first touch) the inner surface of the connecting portion.

LIST OF REFERENCE SIGNS

10 . . . terminal fitting
11 . . . connecting portion
12 . . . crimping portion
13 . . . expanding slot
14 . . . resilient piece
15 . . . narrow portion
16 . . . guiding portion
17 . . . contact area
18 . . . contact portion
22 . . . thick film portion
23 . . . thin film portion
24 . . . inner arcuate surface (inner surface)
25 . . . side surface
27 . . . corner round portion
28 . . . surface portion (surface part)
60 . . . male terminal
90 . . . wire

The invention claimed is:

1. A terminal fitting having opposite front and rear ends and configured to be connected to a mating male terminal, the terminal fitting comprising:

a connecting portion having a plurality of resilient pieces extending axially from a position between the front and rear ends to the front end, the resilient pieces being spaced apart in a circumferential direction via a plurality of expanding slots, each of the resilient pieces having opposed inner and outer surfaces, a contact area on the inner surface of each resilient piece and configured to contact the mating male terminal, and a guiding portion defined forward of the contact area, the guiding portion including a guiding surface configured to guide the mating male terminal to the contact area;

a first plating film on at least the connecting portion; and a second plating film provided on the first plating film at a front part of the contact area adjacent the guiding surface and on part of the guiding surface adjacent the contact areas to define a thick film portion, wherein the first plating film is exposed at areas of the inner surface of each resilient piece rearward of the front part of the contact area.

2. The terminal fitting of claim 1, further comprising a crimping portion substantially adjacent the rear end, and wherein a wire is connectable to an inner surface of the crimping portion by crimping.

3. The terminal fitting of claim 2, wherein the guiding portion is widened toward tips of the plurality of resilient pieces opposite the crimping portion and capable of guiding the male terminal into the connecting portion and a contact portion arranged behind the guiding portion in a guiding direction and capable of being connected to the male terminal when the male terminal is properly inserted.

4. The terminal fitting of claim 1, wherein each of the plurality of resilient pieces includes a concave region spaced from the respective expanding slots and corner round portions defining convexly curved surfaces extending continuously from the concave region of the inner surface of each of the plurality of the resilient pieces to side edges facing into the respective expanding slots and the second film portion includes a surface part in the form of a convexly curved surface extending along the corner round portion.

5. The terminal fitting of claim 1, wherein the inner surface of each of the resilient pieces is tapered toward the outer surface at a front end of the connecting portion to define the guiding surface, and the second plating film is provided on a part of the guiding surface adjacent to the contact area.

6. The terminal fitting of claim 1, further comprising a crimping portion extending axially from the connecting portion, wherein the first plating film is provided on the crimping portion.

7. The terminal fitting of claim 1, wherein the first plating film covers the inner and outer surfaces of each of the plurality of resilient pieces.

8. The terminal fitting of claim 1, wherein an area of the inner surface of each of the resilient pieces where the first plating film is exposed exceeds an area of the inner surface of each of the resilient pieces where second plating film is provided.

9. The terminal fitting of claim 1, wherein the first plating film is applied to all of the terminal fitting.

* * * * *